US006778789B2

(12) United States Patent
Cho et al.

(10) Patent No.: US 6,778,789 B2
(45) Date of Patent: Aug. 17, 2004

(54) POWER CONTROL METHOD AND APPARATUS FOR FUSING ROLLER OF ELETROPHOTOGRAPHIC IMAGE FORMING APPARATUS

(75) Inventors: Durk-Hyun Cho, Suwon-si (KR); Kyung-Woo Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/122,157

(22) Filed: Apr. 15, 2002

(65) Prior Publication Data

US 2003/0091359 A1 May 15, 2003

(30) Foreign Application Priority Data

Nov. 12, 2001 (KR) ..... 2001-0070121

(51) Int. Cl.[7] ..... G03G 15/20
(52) U.S. Cl. ..... 399/69; 219/216
(58) Field of Search ..... 399/67, 69, 70; 219/216, 485, 486, 492, 494, 487, 501, 506; 432/60

(56) References Cited

U.S. PATENT DOCUMENTS 4,053,733 A * 10/1977 Murata et al. ..... 219/494
5,216,225 A * 6/1993 Muto et al. ..... 219/216
5,627,634 A 5/1997 Koh
5,682,576 A * 10/1997 Sakai et al. ..... 399/69
5,907,743 A 5/1999 Takahashi
5,994,671 A 11/1999 Suzuki et al.

FOREIGN PATENT DOCUMENTS

JP 58-197524 A * 11/1983
JP 2000-275998 A * 10/2000
JP 2001-051545 A * 2/2001

* cited by examiner

*Primary Examiner*—William J. Royer
(74) *Attorney, Agent, or Firm*—Robert E. Bushnell, Esq.

(57) ABSTRACT

A power control apparatus and a technique for a fusing roller in an electrophotographic image forming apparatus includes measuring a temperature of a fusing roller, comparing the measured temperature of the fusing roller with a predetermined first control temperature, changing a duty ratio of the power supplied to the fusing roller when the temperature of the fusing roller reaches the predetermined first control temperature, and supplying power to the fusing roller at the changed duty ratio until the temperature of the fusing roller reaches a predetermined target fusing temperature. In the power control technique, as the temperature of the fusing roller increases toward a target fusing temperature, the duty ratio of the power supplied to the fusing roller is lowered. Therefore, a temperature overshoot and temperature ripple during printing operation can be reduced at a lowered temperature-increasing rate. In addition, a problem of short life span of the fusing roller caused by damage of a heater of the fusing roller can be prevented.

14 Claims, 7 Drawing Sheets

POWER CONTROL METHOD AND APPARATUS FOR FUSING ROLLER OF ELETROPHOTOGRAPHIC IMAGE FORMING APPARATUS

CLAIM OF PRIORITY

This application makes reference to, incorporates the same herein, and claims all benefits accruing under 35 U.S.C. §119 from an application for Method and Apparatus for Controlling Power for Fusing Roller of Electrophotographic Image Forming Apparatus earlier filed in the Korean Industrial Property Office on Nov. 12, 2001 and there duly assigned Serial No. 2001-70121.

BACKGROUND OF THE INVENTION

1. Field of the Invention

The present invention relates to an electrophotographic image forming apparatus, and more particularly, to a power control method and apparatus for a fusing roller of an electrophotographic image forming apparatus in which an external source voltage is supplied to a heater of a fusing roller to fuse and fix a toner image to a printing paper.

2. Description of the Related Art

Electrophotographic image forming apparatuses include a controller, a power supply unit, a print engine-power supply controller, and a print engine. The controller, which controls the overall operation of a printer system, and converts a print data input from an external unit such as a personal computer (PC) to a drive data suitable for the operation of the print engine and outputs the drive data to the print engine. The controller determines a power mode and controls power consumption of the print engine through the print engine-power supply controller.

The power supply unit receives electric power from an external power source, e.g., commercial-grade alternating-current source, and generates voltages having levels appropriate for operating the constituent units of the electrophotographic printer including the print engine.

The print engine is responsible for substantial printing operations under the control of the a controller. The print engine includes a laser scanning unit for scanning light onto a rotating photoreceptor web or drum to form a latent electrostatic image thereon, a developer for developing the latent electrostatic image into a toner image, a transfer device for transferring the toner image on the photoreceptor web to a printing paper, a fusing device for fusing and fixing the toner image transferred to the printing paper, and an electrostatic charging roller for erasing the latent electrostatic image remaining on the photoreceptor web for initialization to allow formation of a new latent electrostatic image.

For normal printing operation in the print engine, the fusing device needs to be heated continuously to keep its surface temperature to a target fusing temperature at which the toner image can be fused and fixed to a printing paper. For this purpose, the fusing device uses a halogen lamp as a heater source.

The surface temperature of the fusing device is increased to or maintained at the target fusing temperature by ON/OFF (on and off) control of supplying electric power to or cutting off the supply of electric power to the halogen lamp. In particular, electric power is supplied to the halogen lamp to raise the surface temperature of the fusing device from room temperature to the target fusing temperature. Once the surface temperature of the fusing device reaches the target fusing temperature, the supply of electric power to the halogen lamp is cut off. When the surface temperature of the fusing device drops below the target fusing temperature, electric power is supplied again to the halogen lamp.

In the fusing device using such a halogen lamp as a heater source, radiant heat generated by the halogen lamp is transmitted to the surface of the fusing device through the air, so it takes a considerable time to raise the surface temperature of the fusing device from room temperature to the target fusing temperature. Due to low temperature-increasing rate of the fusing device from room temperature to the target fusing temperature, quite a long warming-up time is required.

To compensate for the above problem, a fusing device capable of being heated rapidly from room temperature to a target fusing temperature was developed. Also, power control methods for such a fusing device are disclosed in U.S. Pat. No. 5,627,634 by Koh entitled "Image Fixing Apparatus having a Heater Energized and Controlled by Electric Energy", U.S. Pat. No. 5,907,743 by Takahashi entitled "Image Heating Apparatus with Control for Phase Control of Alternating Current", and U.S. Pat. No. 5,994,671 by Suzuki et al. entitled "Image Heating Apparatus". These conventional power control methods are applicable to a Canon's film drive type flash image fixing system (Japan) and can prevent flicker from occurring with reduced power consumption.

A fusing device using a heat pipe having a thermal conductivity a few hundred times greater than silver or copper has been developed. A working fluid is contained in the heat pipe, and the heat pipe of the fusing device is heated through phase changes of the working fluid. Although such a fusing device using a heat pipe has an advantage of reduction in warming-up time for printing, there are problems of temperature overshoot in the supply of power and temperature ripple during a temperature sustain period. Accordingly, a heater of a fusing device is easily damaged with a reduced life span.

SUMMARY OF THE INVENTION

To solve the above-described and other problems, it is an object of the present invention to provide a power control method and apparatus for a fusing device of an electrophotographic image forming apparatus in which a temperature overshoot caused by rapidly increasing the temperature of a fusing roller from room temperature to a target fusing temperature and a temperature ripple occurring in the following temperature sustain period can be reduced.

It is another object of the present invention to provide a power control method and apparatus for a fusing device of an electrophotographic image forming apparatus which can prevent the problem of a short life span of the fusing roller caused by damage of a heater of the fusing roller.

To achieve the above and other objects of the present invention, there is provided a power control apparatus for a fusing roller in an electrophotographic image forming apparatus, the power control apparatus including: a fusing roller for fusing toner on a printing paper; a power supply for supplying power to the fusing roller; a thermistor for measuring a temperature of the fusing roller; and a duty controller for controlling a duty ratio of the power supplied from the power supply to the fusing roller by comparing the temperature of the fusing roller measured by the thermistor with a predetermined target fusing temperature. The duty controller changes the duty ratio of the power when the temperature of the fusing roller reaches a first control temperature lower than the target fusing temperature.

The present invention also provides a power control apparatus for a fusing roller in an electrophotographic image forming apparatus, the power control apparatus including: a fusing roller including an inner tube containing a predetermined working fluid for fusing toner on a printing paper; a power supply for supplying power to the fusing roller; a thermistor for measuring a temperature of the fusing roller; and a duty controller for controlling a duty ratio of the power supplied from the power supply to the fusing roller by comparing the temperature of the fusing roller measured by the thermistor with a predetermined target fusing temperature. The duty controller changes the duty ratio of the power when the temperature of the fusing roller reaches a first control temperature lower than the target fusing temperature.

There is also provided a power control method for a fusing roller in an electrophotographic image forming apparatus, the method including: (a) measuring a temperature of a fusing roller; (b) comparing the temperature of the fusing roller measured in the act of (a) with a predetermined first control temperature; (c) changing a duty ratio of the power supplied to the fusing roller when the temperature of the fusing roller reaches the predetermined first control temperature; and (d) supplying power to the fusing roller at the duty ratio changed in the act of (c) until the temperature of the fusing roller reaches a predetermined target fusing temperature.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
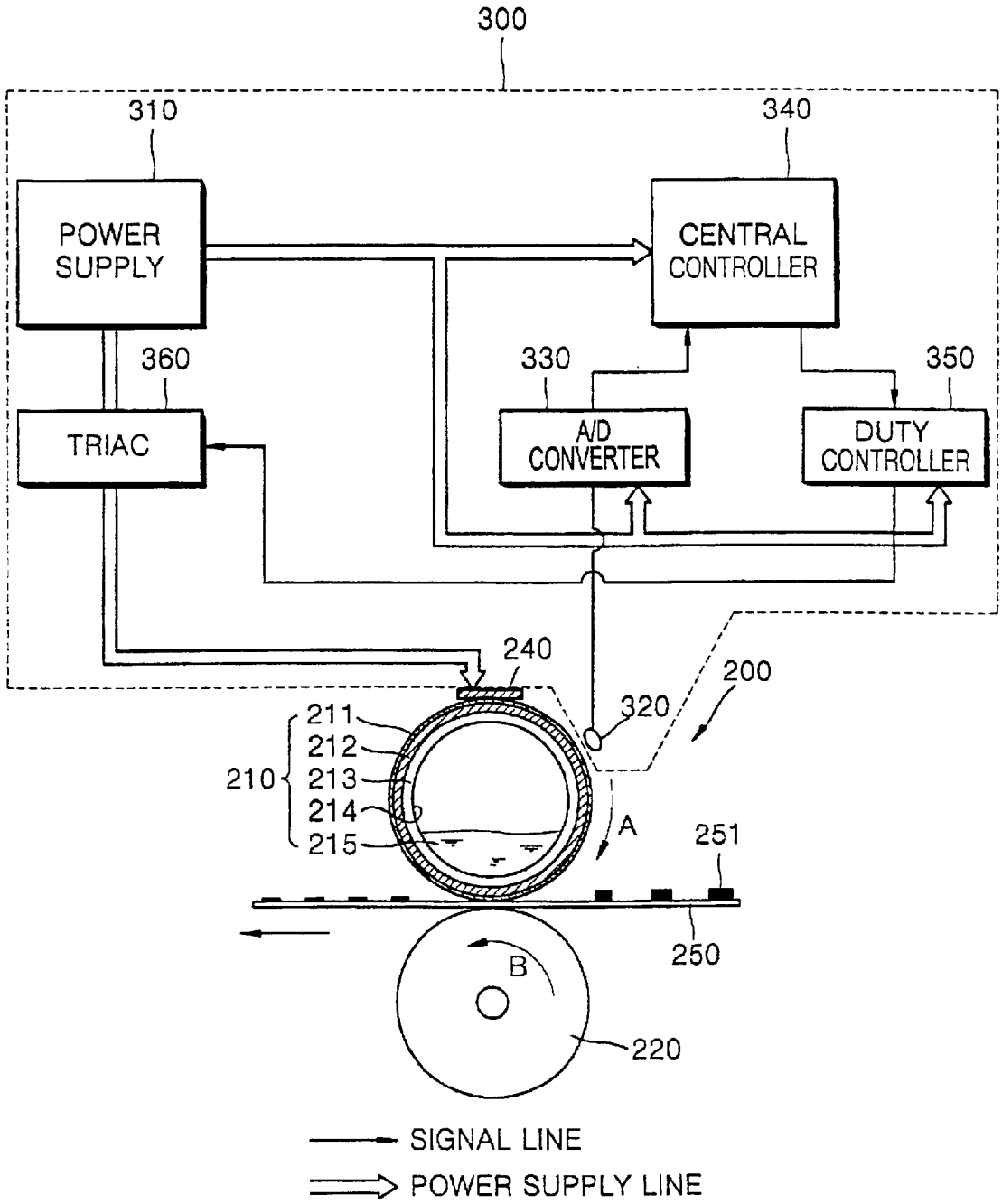
FIG. 1 shows a fusing device and a power control apparatus using a power control method according to the present invention.

Turning now to the drawings, a fusing device of an electrophotographic image forming apparatus and a power control apparatus using a power control method according to the present invention are shown in FIG. 1. Unlike a conventional fusing device including a halogen lamp as a heater source, a fusing device 200 shown in FIG. 1 includes a heat pipe having a high temperature-increasing rate.

Referring to FIG. 1, the fusing device 200 of an electrophotographic image forming apparatus that fuses and fixes a toner image 251 transferred from a photoreceptor (not shown) to a printing paper 250 by a transfer device (not shown) to the printing paper 250, includes a fusing roller 210 rotating in a direction in which a printing paper 250 is discharged, that is, direction A indicated by an arrow, and a pressing roller 220 which rotates in direction B indicated by an arrow while pressing the fusing roller 210 such that the printing paper 250 passes therebetween.

The fusing roller 210 includes a cylindrical fusing unit 212 on the surface of which a protective layer 211 of a TEFLON coating is formed, a heater 213 which is installed within the fusing unit 212 and supplied with electric power from a power supply 310 for heat generation, and an inner tube 214 which is installed within the heater 213 and both ends of which are sealed hermetically to maintain a predetermined pressure.

An insulation layer (not shown) may be formed on the outer surface of the inner tube 214 and the inner surface of the fusing unit 212. Preferably, the heater 213 is a resistive coil surrounding spirally the inner tube 214. Preferably, the inner surface of the inner tube 214 has a wick-like structure to allow uniform transmission of heat generated by the heater 213 and the heat of vaporization of a working fluid throughout the inner tube 214.

The working fluid 215 is vaporized due to heat generated and transmitted from the heater 213 and transmits the heat to the fusing unit 212, thereby functioning as a thermal medium which prevents a temperature deviation in the surface of the fusing unit 212 and heats the entire fusing unit 212 within a short time. The working fluid 215 occupies 5–50% of the interior volume of the inner tube 214 and preferably 5–15% of the interior volume of the inner tube 214. If the working fluid 215 occupies 5% or less of the interior volume of the inner tube 214, a dry-out phenomenon is very likely to occur. Accordingly, it is preferable to avoid the above case of 5% or less. When the work fluid 215 is above 15%, heating time can be too long. When the work fluid 215 is above 50%, not only can the heating time be too long but the fusing roller 210 can be too heavy to rotate easily.

A thermostat 240 is installed above the fusing roller 210 such that it can cut off the supply of power to the fusing roller 210 in order to prevent overheating when the surface temperature of the fusing roller 210 exceeds a predetermined threshold temperature, thereby protecting the fusing roller 210 and other neighboring elements from damage.

In FIG. 1, the power control apparatus 300 of the electrophotographic image forming apparatus for controlling the power supply to the fusing roller 210 includes a power supply 310, a thermistor 320, an analog-to-digital (A/D) converter 330, a central controller 340, and a duty controller 350.

The power supply 310 supplies power to the central controller 340, the A/D converter 330, the duty controller 350, and the fusing device 200. The thermistor 320 is installed near the fusing roller 210 and periodically measures the surface temperature of the fusing roller 210. The A/D converter 330 reads an analog value of the temperature measured by the thermistor 320, converts the read analog value to a digital signal, and transmits the digital signal to the central controller 340.

The central controller 340, which is a unit to perform necessary operations for the control of the electrophotographic image forming apparatus, compares a measured value of temperature from the A/D converter 330 with a predetermined control temperature and outputs a power control signal having a duty ratio corresponding to the result of the comparison to the duty controller 350.

The duty controller 350 drives a TRIAC (triode AC switch) 360 connected to the power supply 310 using a control signal corresponding to the power control signal received from the central controller 340. Advantageously, the TRIAC 360 neither generates high-frequency waveforms nor causes waveform distortion.

Figure 2:
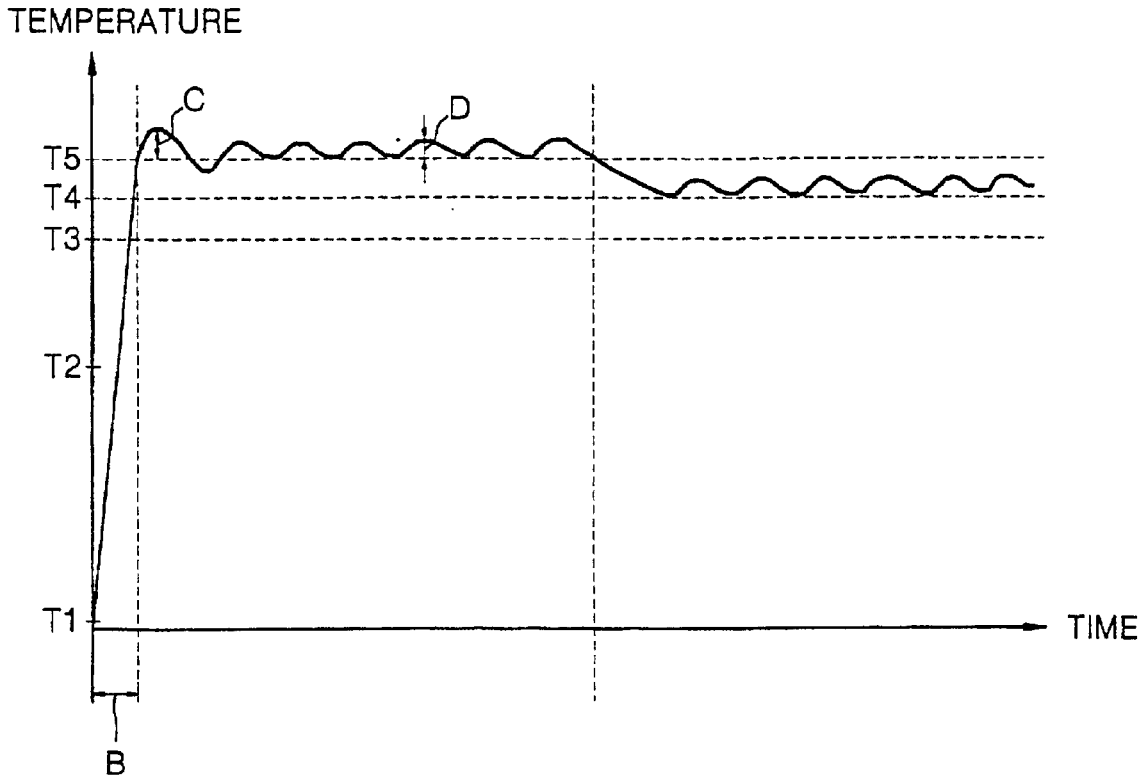
FIG. 2 is a graph showing variations in temperature of a fusing roller with respect to time in a fusing device according to the present invention.

FIG. 2 is a graph showing variations in temperature of the fusing roller with respect to time in a fusing device according to the present invention. Referring to FIG. 2, the X-axis represents time, and the Y-axis represents the temperature of the fusing roller 210 shown in FIG. 1. Interval B corresponds to a period of time during which the temperature of the fusing roller 210 is raised from room temperature T1 to a target fusing temperature T5.

The larger the power supplied to the fusing roller 210 during the interval B, the shorter the time required to raise the temperature of the fusing roller 210 from the room temperature T1 to the target fusing temperature T5. The smaller the power supplied to the fusing roller 210 during the interval B, the longer the time required to raise the temperature of the fusing roller 210 from the room temperature T1 to the target fusing temperature T5.

In an electrophotographic image forming apparatus operated using the power control method according to the present invention, it is preferable that the temperature of the fusing roller 210 is raised from the room temperature T1 to the target fusing temperature T5 within about 10–12 seconds. "Target fusing temperature" refers to a temperature at which a toner image is fused and fixed stably to a printing paper, so the temperature of the fusing roller must be maintained at that temperature.

If the room temperature T1 is in the range of 20–30° C. (Celsius), the target fusing temperature T5 is preferably set to 185° C. Therefore, it takes about 10–12 seconds for the temperature of the fusing roller 210 to be increased from about 25° C. to a target fusing temperature T5 of 185° C.

For continuous printing, the target fusing temperature T5 for the fusing roller 210 is lowered to a (second) target fusing temperature T4 within the range of 170–180° C. after 5 minutes from the initiation of printing operation. The duration of 5 minutes is a period of time required to stabilize the fusing roller including a heater to which power is supplied using the power control method according to the present invention.

Because the fusing roller 210 and the pressing roller 220 can retain the heat transmitted through the heater 213, it is unnecessary to raise continuously the temperature of the fusing roller 210 up to the target fusing temperature T5 to fuse and fix the toner image 251 (see FIG. 1) to the printing paper 250 (see FIG. 1). Therefore, there is a need to lower the target fusing temperature itself to reduce power consumption of the fusing device. For this reason, the target fusing temperature is set to a target fusing temperature T5 of 185° C. for 5 minutes from the initiation of printing operation and then to a target fusing temperature T4 of 175° C., about 10° C. lower than the target fusing temperature T5, after 5 minutes.

The electrophotographic image forming apparatus having the structure described above can raise the temperature of the fusing roller 210 within a short time by supplying a large amount of electric power to the fusing roller 210, compared to a conventional electrophotographic image forming apparatus that raises the temperature of a fusing roller using a halogen lamp. Therefore, as shown in FIG. 2, overshoot "C", which is a rise in the surface temperature of the fusing roller 210 after the supply of electric power to the fusing roller 210 is cut off, occurs. Then, ripple "D" in the surface temperature of the fusing roller 210 occurs during the following printing operation.

If the temperature overshoot "C" becomes greater, the temperature of the fusing roller 210 and the pressing roller 220 increases and a seizing phenomenon, i.e., sticking between the fusing roller 210 and the pressing roller 220 is likely to occur. Also, frames made of polymer and in contact with the fusing roller 210 may deform by thermal impact, or degradation in print quality, called "hot offset", occurs due to residual toner on the surface of the fusing roller 210.

Therefore, the interval B is divided into a plurality of temperature regions based on a control temperature, and the temperature of the fusing roller 210 is compared with the control temperature in every temperature region to supply alternating-current (AC) power at different duty ratios for each temperature region (through control of the number of waveforms).

In other words, as the temperature of the fusing roller 210 becomes closer to the target fusing temperature T5, power is supplied at a lower duty ratio (by reducing the number of waveforms supplied) to minimize a temperature overshoot caused by a sudden rise in temperature within a short time.

Figure 3:
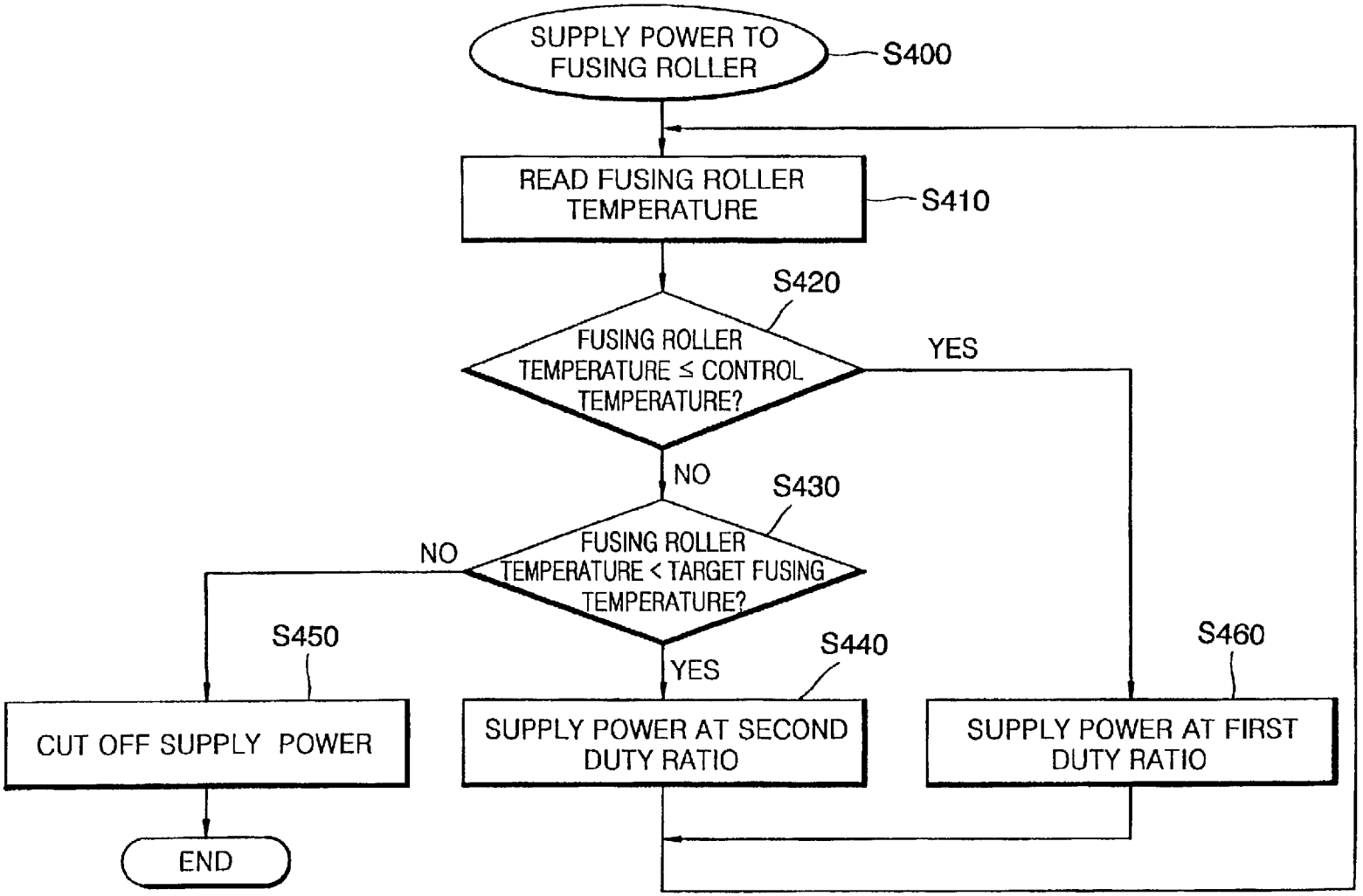
FIG. 3 is a flowchart illustrating a preferred embodiment of a power control method for as a fusing roller according to the present invention.

A preferred embodiment of the power control method in the fusing device according to the present invention will be described with reference to FIGS. 1 and 3. The algorithm illustrated in FIG. 3 is performed by the central controller 340 shown in FIG. 1.

When a print data is input through a communication interface from a user computer connected to an electrophotographic image forming apparatus, power is supplied to the fusing roller 210 (Step S400). The temperature of the fusing roller 210 measured by the thermistor 320 is read continuously or periodically every 200 milliseconds (ms) through the A/D converter 330 upon the supply of the power to the fusing roller 210 (Step S410). Next, the following control operations are performed.

If the temperature of the fusing roller 210 is less than or equal to a control temperature (Step S420), power is supplied at a first duty ratio to rapidly increase the temperature of the fusing roller 210 (Step S460). The control temperature is in the range of 160–170° C., and preferably at 165° C. Preferably, the first duty ratio is 100% of a source voltage.

If the temperature of the fusing roller 210 is greater than the control temperature of 165° C. and less than the target fusing temperature of 185° C. in Step S430, power is supplied at a second duty ratio (Step S440) to raise the temperature of the fusing roller 210 at a relatively low rate.

This appropriate control of the temperature-increasing rate can minimize the temperature overshoot "C" and temperature ripple "D" as shown in FIG. 2. The second duty ratio is in the range of 20–50% of the source voltage, and preferably 33%. When the supply of power to the fusing roller 21 is controlled at a duty ratio of 33%, the temperature overshoot "C" is minimized to be 20° C. or less. Also, the temperature ripple "D" occurring during the following printing operation is minimized to be 10° C. or less.

If it is determined in Step S430 that the temperature of the fusing roller 210 is greater than or equal to 185° C. (T5), the supply of power to the fusing roller 210 is cut off (Step S450). In this case, the thermistor 320 continues to sense the temperature of the fusing roller 210 in order to keep the temperature of the fusing roller 210 at the target fusing temperature T5. When the temperature of the fusing roller 210 drops below the target fusing temperature T5, power is supplied again. When the temperature of the fusing roller 210 exceeds the target fusing temperature T5, the supply of power is cut off.

Figure 4:
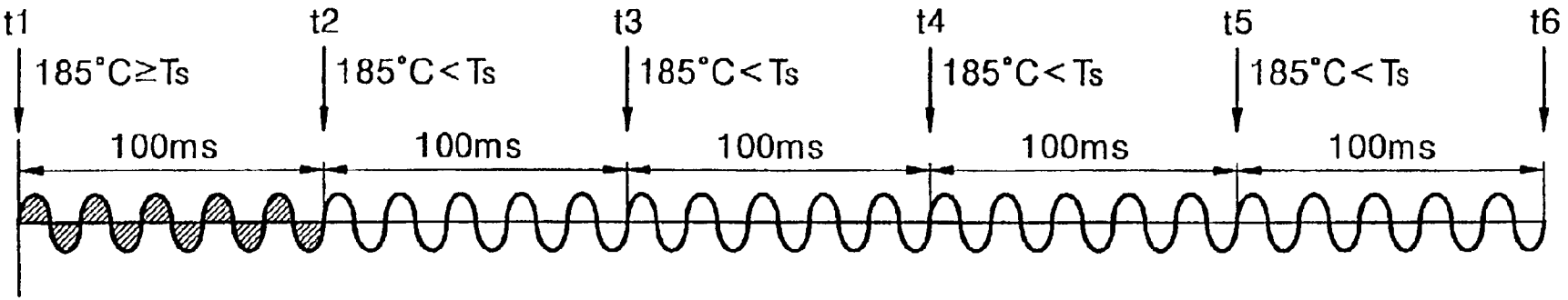
FIG. 4 is a timing diagram of voltage waveforms supplied to a fusing roller at a 100% duty ratio.
Figure 5:
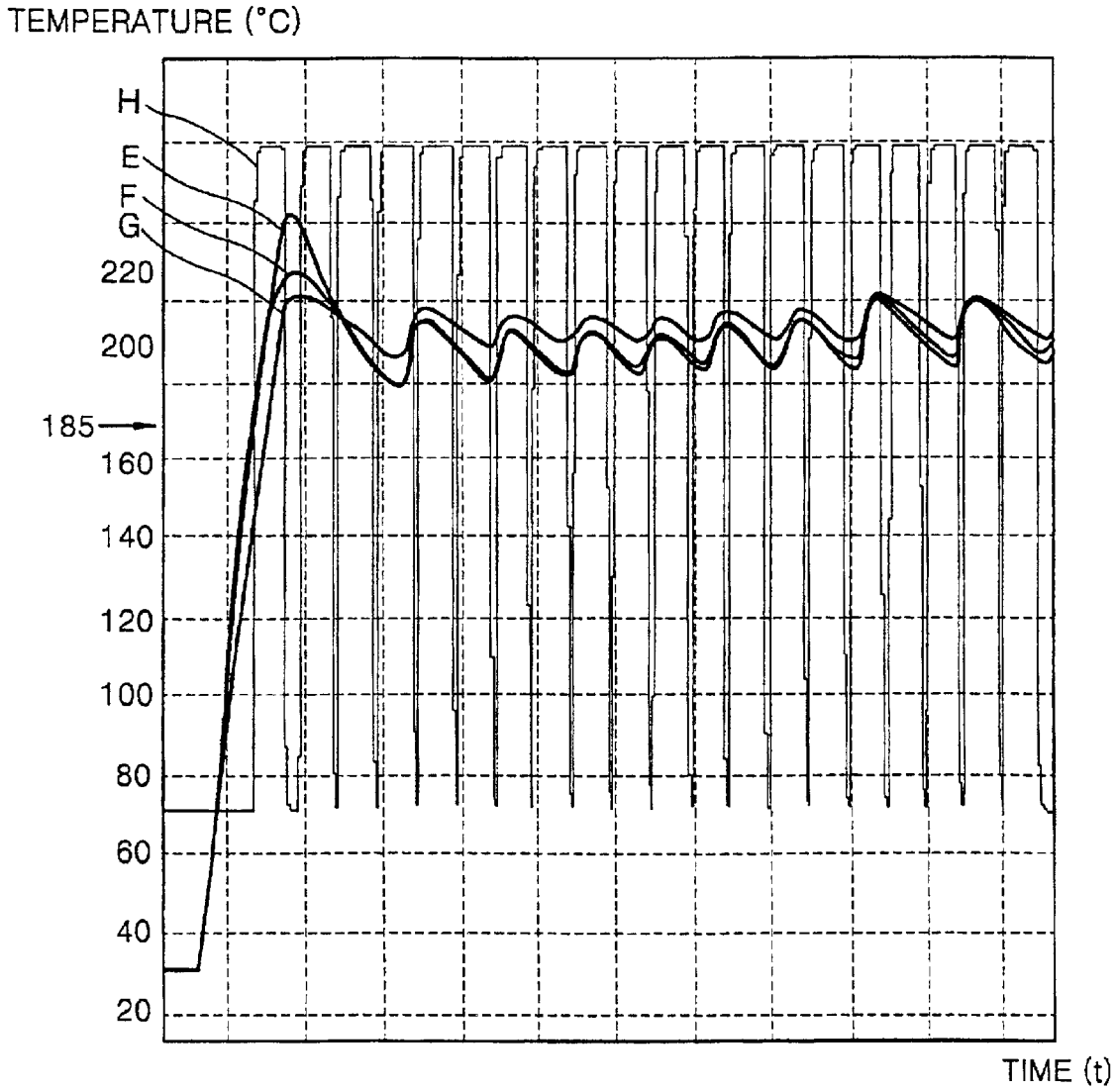
FIG. 5 is a graph showing variations in temperature of the fusing roller with respect to time according to the power control method of FIG. 4.

FIG. 4 is a timing diagram of voltage waveforms supplied to a fusing roller at a 100% duty ratio. FIG. 5 is a graph showing variations in temperature of the fusing roller with respect to time according to the power control method of FIG. 4. In FIG. 4, an interval including hatched waveforms called "full-on-pulses" represents a period of time during which a source voltage is supplied to a heater of the fusing roller. Unhatched waveforms are called "full-off-pulses". When a voltage of 100% duty ratio is applied, all 10 half waveforms are full-on-pulses. In FIG. 5, rectangular waveforms H represent DC (direct current) voltages output from an exit sensor indicating the state of print paper feed, reference character E denotes a temperature variation at the center of the fusing roller 210 (see FIG. 1) with respect to time, and reference characters F and G denote temperature variations at both edges of the fusing roller 210.

In particular, referring to FIGS. 4 and 5, to through t6 denote points of time at 100-ms (milliseconds) intervals at which the temperature of the fusing roller 210 is measured by the thermistor 320. $T_S$ denotes a value of the temperature of the fusing roller 210 measured by the thermistor 320. For example, when an AC (alternating current) voltage of 220 V (volts) and 50 Hz (hertz or cycles per second) is supplied to the fusing roller 210 (see FIG. 1) at a 100% duty ratio from t1 to t2, an overshoot of about 37° C. occurs from the target fusing temperature of 185° C. (T5 of FIG. 2) while printing on a first sheet of printing paper. Here, a temperature ripple during the following operation is less than 10° C.

Figure 6:
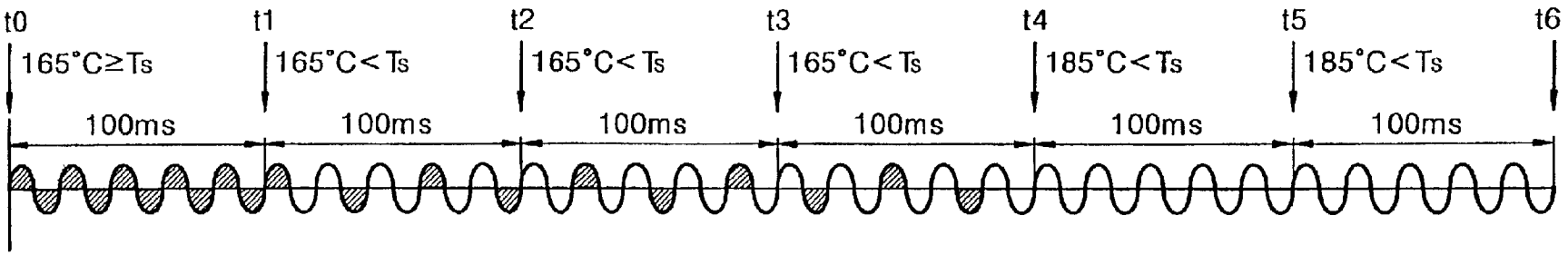
FIG. 6 is a timing diagram of voltage waveforms supplied to a fusing roller at varying duty ratios using a power control method according to the present invention.
Figure 7:
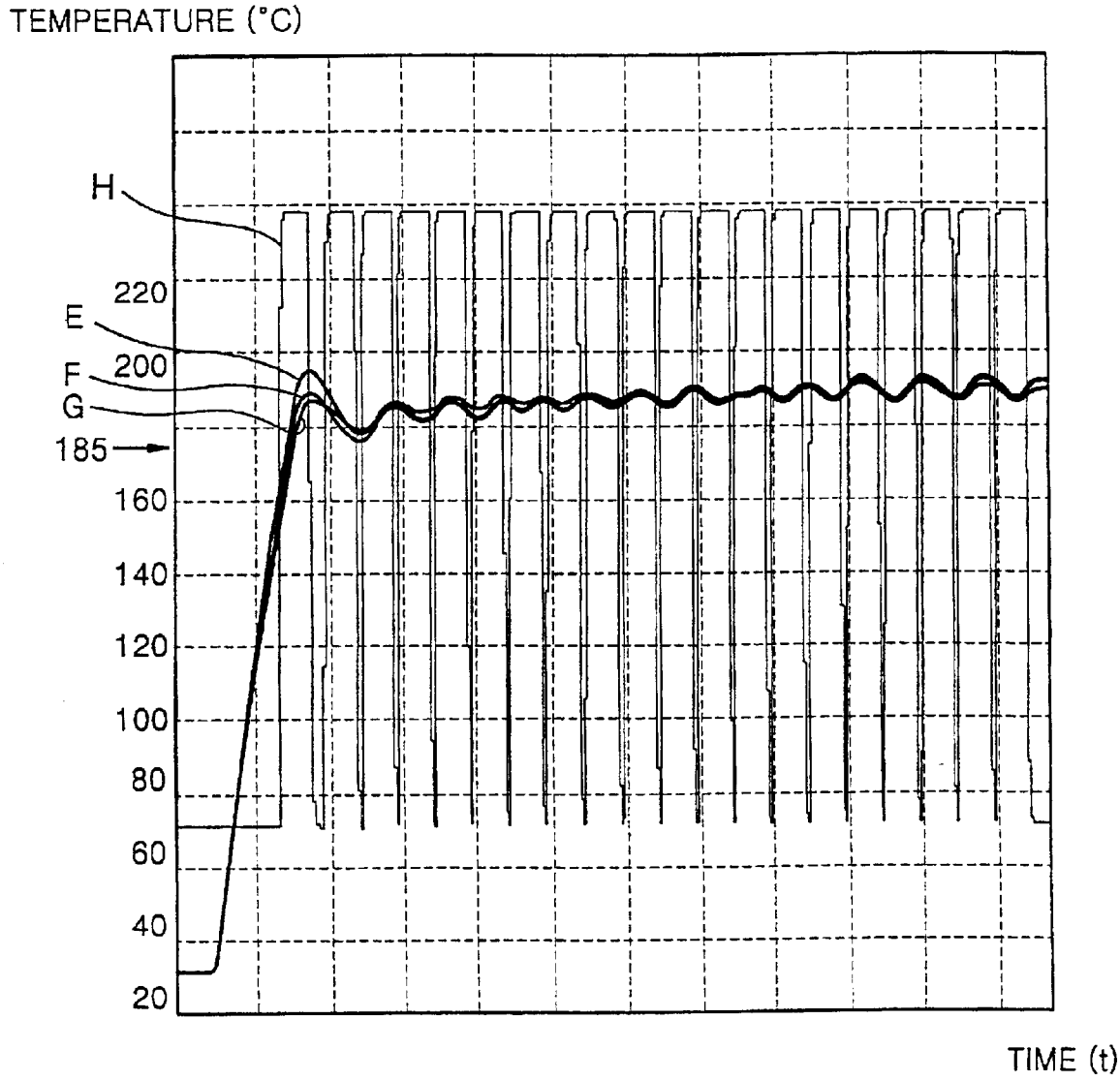
FIG. 7 is a graph showing variations in temperature of the fusing roller with respect to time according to the power control method of FIG. 6.

FIG. 6 is a timing diagram of voltage waveforms supplied to a fusing roller at varying duty ratios using a power control method according to the present invention. FIG. 7 is a graph showing variations in temperature of the fusing roller with respect to time according to the power control method of FIG. 6. In FIGS. 6 and 7, the same reference characters as used in FIGS. 4 and 5 indicate the same factors as those of FIGS. 4 and 5.

For example, referring to FIGS. 6 and 7, in the power control method according to the present invention, an AC voltage of 220 V and 50 Hz is supplied from t0 to t1 at a 100% duty ratio until the temperature of the fuising roller 210 reaches a control temperature of about 165° C., and then at a 33% duty ratio from t1 to t4. In this case, an overshoot of about 10° C. occurs from the first target fusing temperature T5 of 185° C. (see FIG. 2) while printing on a first sheet of printing paper. Here, a temperature ripple during the following operation is about 5° C.

In other words, in raising the temperature of the fusing roller 210 from room temperature to a target fusing temperature, power is supplied at a 100% duty ratio to a control temperature and at a 33% duty ratio from the control temperature to the target fusing temperature. As a result, although the temperature-increasing time becomes slightly longer, a temperature overshoot or temperature ripple can be reduced. Apparently, controlling the duty ratio to 100% and 33% of the source voltage based on a predetermined control temperature in the supply of power to the fusing roller can reduce temperature overshoot and temperature ripple, compared to a power control method of supplying power at a constant 100% duty ratio.

Alternatively, power of different duty ratios can be supplied to the fusing roller 210 based on two control temperatures: a first control temperature T3 and a second control temperature T2 lower than the first control temperature T3 (see FIG. 2). The second control temperature T2 is in the range of 120–130° C., and preferably at 125° C.

In particular, when the temperature of the fusing roller 210 is less than a second control temperature T2 of 125° C., power is supplied to the fusing roller 210 at a first duty ratio. When the temperature of the fusing roller 210 is greater than the second control temperature T2 and less than the first control temperature T3, power is supplied to the fusing roller 210 at a third duty ratio. The third duty ratio is lower than the first duty ratio and preferably in the range of 60%–80% of a source voltage. When the temperature of the fusing roller 210 is greater than the first control temperature T3 and less than or equal to the target fusing temperature T5, power is supplied to the using roller 210 at a second duty ratio. The second duty ratio is lower than the third duty ratio and preferably in the range of 20–50% of a source voltage. Alternatively, other variations are also possible where the control temperatures can be greater than two and the duty ratios can be varied in other ways.

As described above, in a power control method for a fusing roller in an electrophotographic image forming apparatus according to the present invention, power is supplied to the fusing roller at varying duty ratios. As the temperature of the fusing roller increases toward a target fusing temperature, the duty ratio of power voltage is lowered. According to the present invention, a temperature overshoot and temperature ripple during printing operation can be reduced at a lowered temperature-increasing rate. In addition, a problem of short lifespan of the fusing roller caused by damage of a heater of the fusing roller can be prevented.

While this invention has been particularly shown and described with reference to a preferred embodiment thereof, it will be understood by those skilled in the art that various changes in form and details may be made therein. Therefore, the true scope of the invention will be defined by the appended claims.

What is claimed is:

1. A power control apparatus for a fusing roller in an electrophotographic image forming apparatus, the power control apparatus comprising:

a fusing roller for fusing toner on a printing medium;

a power supply for supplying power to said fusing roller;

a thermistor measuring a temperature of said fusing roller; and a duty controller for controlling a duty ratio of the power supplied from said power supply to said fusing roller by comparing the temperature of said fusing roller measured by said thermistor with a predetermined target fusing temperature, said duty controller changing the duty ratio of the power when the temperature of said fusing roller reaches a first control temperature lower than the target fusing temperature, further comprised of said duty controller changing the duty ratio of the power at a second control temperature lower than the first control temperature and gradually reducing the duty ratio of the power supplied from said power supply to said fusing roller as the temperature of said fusing roller increases.

2. The power control apparatus of claim 1, with said fusing roller including a heater unit heating a working fluid within an inner tube within said fusing roller to transmit heat for said fusing roller.

3. The power control apparatus of claim 2, with said heater being a resistive coil and the working fluid occupying 5 to 15% of the interior volume of said inner tube.

4. A power control apparatus for a fusing roller in an electrophotographic image forming apparatus, the power control apparatus comprising:

a fusing roller for fusing toner on a printing medium;

a power supply for supplying power to said fusing roller;

a thermistor measuring a temperature of said fusing roller; and a duty controller for controlling a duty ratio of the power supplied from said power supply to said fusing roller by comparing the temperature of said fusing roller measured by said thermistor with a predetermined target fusing temperature, said duty controller changing the duty ratio of the power when the temperature of said fusing roller reaches a first control temperature lower than the target fusing temperature, further comprised of said duty controller changing the duty ratio of the power at a second control temperature lower than the first control temperature, the duty ratio between the second control temperature and the first control temperature being greater than the duty ratio between the first control temperature and the target fusing temperature.

5. A power control apparatus for a fusing roller in an electrophotographic image forming apparatus, the power control apparatus comprising:

a fusing roller for fusing toner on a printing medium;

a tower supply for supplying rower to said fusing roller;

a thermistor measuring a temperature of said fusing roller; and a duty controller for controlling a duty ratio of the power supplied from said power supply to said fusing roller by comparing the temperature of said fusing roller measured by said thermistor with a predetermined target fusing temperature, said duty controller changing the duty ratio of the power when the temperature of said fusing roller reaches a first control temperature lower than the target fusing temperature, further comprised of a temperature of ripple at the surface of said fusing roller being less than 5° C.

6. A power control apparatus for a fusing roller in an electrophotographic image forming apparatus, the power control apparatus comprising:

a fusing roller including an inner tube comprising a predetermined working fluid accommodating fusing toner on a printing medium;

a power supply for supplying power to said fusing roller;

a thermistor measuring a temperature of said fusing roller; and a duty controller for controlling a duty ratio of the power supplied from said power supply to said fusing roller by comparing the temperature of said fusing roller measured by said thermistor with a predetermined target fusing temperature, said duty controller changing the duty ratio of the power when the temperature of said fusing roller reaches a first control temperature lower than the target fusing temperature.

7. The power control apparatus of claim 6, further comprised of said duty controller changing the duty ratio of the power at a second control temperature lower than the first control temperature and gradually reducing the duty ratio of the power supplied from said power supply to said fusing roller as the temperature of said fusing roller increases.

8. A power control method for a fusing roller in an electrophotographic image forming apparatus, the method comprising:

measuring a temperature of a fusing roller, comparing the temperature of the fusing roller, measured in said act of measuring the temperature of said fusing roller, with a predetermined first control temperature;

changing a duty ratio of the power supplied to said fusing roller when the temperature of said fusing roller reaches the predetermined first control temperature; and supplying power to said fusing roller at the duty ratio changed in said act of changing a duty ratio until the temperature of the fusing roller reaches a predetermined target fusing temperature.

9. The power control method of claim 8, said act of supplying power to said fusing roller further comprised of when the temperature of said fusing roller reaches the predetermined target fusing temperature, a temperature of overshoot at the surface of said fusing roller being less than 10° C.

10. The power control method of claim 9, further comprised of after the temperature of said fusing roller reaching the predetermined target fusing temperature, a temperature of ripple at the surface of said fusing roller being less than or equal to 50° C.

11. The power control method of claim 8, in said act of changing the duty ratio, the duty ratio of the power supplied to said fusing roller being gradually lowered as the temperature of said fusing roller increases.

12. The power control method of claim 8, said act of changing the duty ratio being the lowering of the duty ratio when the temperature of said fusing roller reaches the predetermined first control temperature before reaching said target fusing temperature, said predetermined first control temperature being less than the target fusing temperature.

13. The power control method, comprising:

reading a temperature of a fusing roller in an image forming apparatus after supplying power to said fusing roller;

supplying power to said fusing roller at a first duty ratio to increase temperature of said fusing roller when the temperature of said fusing roller is less than or equal to a first control temperature and before reaching a target fusing temperature;

supplying power to said fusing roller at a second duty ratio to increase temperature of said fusing roller when the temperature of the fusing roller is greater than the first control temperature and less than the target fusing temperature before reaching the target fusing temperature, the first duty ratio being different than the second duty ratio;

cutting off the power to said fusing roller when the temperature of said fusing roller is greater than or equal to the target fusing temperature;

supplying power to said fusing roller when the temperature of said fusing roller is less than the target fusing temperature after said act of cutting off the power to said fusing roller; and reducing the target fusing temperature after a predetermined period of time from an initial printing operation when printing continuously for more than the predetermined period of time.

14. A power control apparatus for an image forming apparatus, the power control apparatus comprising:

a fusing roller accommodating fusing toner on a printing medium;

a temperature sensor determining a temperature of said fusing roller; and a controller unit controlling a duty ratio of a power supplied to said fusing roller by comparing the determined temperature of said fusing roller with a predetermined target fusing temperature and a plurality of predetermined control temperatures being lower than the target fusing temperature, said controller unit reducing the duty ratio of the power in successive steps at each one of said plurality of control temperatures as the determined temperature of said fusing roller increases toward the target fusing temperature before reaching the target fusing temperature.

* * * * *